US006450616B1

(12) United States Patent
Kubota et al.

(10) Patent No.: US 6,450,616 B1
(45) **Date of Patent: *Sep. 17, 2002**

(54) SUBSTRATE WITH MULTIPLE HEAT GENERATING ELEMENTS FOR EACH EJECTION OPENING, INK JET PRINTING HEAD AND INK-JET PRINTING APPARATUS WITH SAME

(75) Inventors: Masahiko Kubota; Masami Ikeda, both of Tokyo; Masami Kasamoto, Ayase; Hajime Kaneko, Kodaira; Tsutomu Abe, Isehara; Hiroyuki Ishinaga; Jun Kawai, both of Tokyo; Keisuke Matsuo, Yokohama; Masaaki Okada, Sanjo, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/843,074

(22) Filed: Apr. 11, 1997

(30) Foreign Application Priority Data

Apr. 22, 1996 (JP) ..... 8-100574

(51) Int. Cl.[7] ..... B41J 2/14; B41J 2/16; B41J 2/05

(52) U.S. Cl. ..... 347/48; 347/58

(58) Field of Search ..... 347/48, 57–59, 347/62, 15, 13, 12

(56) References Cited

U.S. PATENT DOCUMENTS 4,251,824 A 2/1981 Hara et al. ..... 347/57
4,313,124 A 1/1982 Hara
4,345,262 A 8/1982 Shirato et al.

(List continued on next page.)

FOREIGN PATENT DOCUMENTS

| | | | |
|---|---|---|---|
| EP | 0593071 | 4/1994 | ..... B41J/2/058 |
| EP | 0678386 | 10/1995 | ..... B41J/2/05 |
| EP | 0694395 | 1/1996 | ..... B41J/2/05 |
| EP | 0707963 | 4/1996 | ..... B41J/2/05 |
| JP | 54-56847 | 5/1979 | ..... B41M/5/26 |
| JP | 54-59936 | 5/1979 | ..... B41J/3/04 |
| JP | 57-72867 | 5/1982 | ..... B41J/3/04 |
| JP | 57-72868 | 5/1982 | ..... B41J/3/04 |
| JP | 59-123670 | 7/1984 | ..... B41J/3/04 |
| JP | 59-138461 | 8/1984 | ..... B41J/3/04 |
| JP | 60-71260 | 4/1985 | ..... B41J/3/04 |
| JP | 62-48585 | 3/1987 | ..... B41M/5/18 |
| JP | 2-239940 | 9/1990 | ..... B41J/2/05 |
| JP | 7-148964 | 6/1995 | ..... B41J/2/355 |

*Primary Examiner*—John Barlow
*Assistant Examiner*—Michael S Brooke
(74) *Attorney, Agent, or Firm*—Fitzpatrick, Cella, Harper & Scinto

(57) ABSTRACT

A substrate for an ink-jet element of an ink-jet printing head which ejects ink through ejection openings includes heating elements provided for each of the ejection openings and which generate thermal energy for ejecting the ink, a data holding circuit for holding an image data for driving the heat generating elements, by holding the image data in the number of bits corresponding to the number of ejection openings, and a driving circuit for driving the heating elements in units of the plural heating elements provided for each of the plural ejection openings based on the image data. A selection circuit selects at least one of the plural of heating elements provided corresponding to each of the ejection openings for driving. An ink-jet printing head and ink-jet printing apparatus employ such a substrate.

51 Claims, 14 Drawing Sheets

U.S. PATENT DOCUMENTS 4,459,600 A 7/1984 Sato et al.
4,463,359 A 7/1984 Ayata et al.
4,558,333 A 12/1985 Sugitani et al.
4,608,577 A 8/1986 Hori
4,672,398 A 6/1987 Kuwabara et al.
4,723,129 A 2/1988 Endo et al.
4,740,796 A 4/1988 Endo et al.
4,947,192 A 8/1990 Hawkins et al. ..... 347/59
4,970,599 A * 11/1990 Nobuta ..... 358/296
5,081,474 A 1/1992 Shibata et al. ..... 347/59
5,172,139 A 12/1992 Sekiya et al. ..... 347/15
5,262,802 A 11/1993 Karita et al.
5,322,811 A * 6/1994 Komuro ..... 347/59 X
5,479,196 A 12/1995 Inada
5,604,599 A * 2/1997 Ono ..... 358/296
5,731,828 A * 3/1998 Ishinaga ..... 347/62

* cited by examiner

| INPUT TERMINAL 3 | INPUT TERMINAL 2 | INPUT TERMINAL 1 | HEAT NOZZLE |
|---|---|---|---|
| 0 | 0 | 1 | 1~40 |
| 0 | 1 | 0 | 41~80 |
| 0 | 1 | 1 | 81~120 |
| 1 | 0 | 0 | 121~160 |
| 1 | 0 | 1 | 161~200 |

FIG.7

| INPUT TERMINAL 3 | INPUT TERMINAL 2 | INPUT TERMINAL 1 | HEAT NOZZLE |
|---|---|---|---|
| 0 | 0 | 1 | 1~8,41~48,81~88,121~128 |
| 0 | 1 | 0 | 9~16,49~56,89~96,129~136 |
| 0 | 1 | 1 | 17~24,57~64,97~104,137~144 |
| 1 | 0 | 0 | 25~32,65~72,105~112,145~152 |
| 1 | 0 | 1 | 33~40,73~80,113~120,153~160 |

FIG.10

| SMALL EJECTION HEATER | LARGE EJECTION HEATER |
|---|---|
| OFF | OFF |
| EJECTION AMOUNT=0ng | |

| SMALL EJECTION HEATER | LARGE EJECTION HEATER |
|---|---|
| ON | OFF |
| EJECTION AMOUNT=20ng | |

| SMALL EJECTION HEATER | LARGE EJECTION HEATER |
|---|---|
| ON | ON |
| EJECTION AMOUNT=80ng | |

SUBSTRATE WITH MULTIPLE HEAT GENERATING ELEMENTS FOR EACH EJECTION OPENING, INK JET PRINTING HEAD AND INK-JET PRINTING APPARATUS WITH SAME

BACKGROUND OF THE INVENTION

1. Field of the Invention

The present invention relates to an ink-jet element substrate, an ink-jet printing head and an ink-jet printing apparatus applicable as an output terminal of a copy machine, facsimile machine, word processor, a host computer and the like.

2. Description of the Related Art

An ink-jet printing apparatus has been widely used in modern business office and other clerical work section required silence, as non-impact printing apparatus. For various advantages, such as capability of high density and high speed printing, relatively easy maintenance and possibility to be maintenance free, development and improvement have been progressed for the ink-jet printing apparatus.

Among such ink-jet printing apparatus, the ink-jet printing apparatus disclosed in Japanese Patent Application Laid-open No. 59936/1979, for example, has been strongly desired to be realized for capability of high density printing and high speed printing for its structural feature and for quite easiness of designing and manufacturing of so-called full-line printing head extending overall width direction of a printing medium.

However, even in such ink-jet printing apparatus, for realizing full-line printing with high density, there has been arisen various unsolved problems in design structure of the printing head and in productivity and manufacturing ability directly associated with printing precision, certainty in printing, durability and the like.

As measures for solving such problems, Japanese Patent Application Laid-Open Nos. 72867/1982 and 72868/1982 disclose an ink-jet printing apparatus having a structure, in which the ink-jet printing head is integrated at high density for achieving high density and high speed printing, for example.

On the other hand, as the ink-jet printing head, there has been proposed a multi-value output color ink-jet printing head, in which a plurality of heating elements are disposed in an ink passages forming nozzles for ink ejection, as disclosed in Japanese Patent Application Publication No. 48585/1987, for example. The disclosed printing head has n in number of heating element within one ink passage. Each of the heating elements are independently connected to driver so as to be driven independently of the other. Sizes of respective heating elements are differentiated to each other so as to differentiate heat generating amounts thereof. Accordingly, the printing dots upon printing with the n in number of heating elements are differentiated in size. Thus, $\{{}_nC_{n-1}+{}_nC_{n-2}+\ldots+{}_nC_2+{}_nC_1+1\}$ different printing dots can be formed. Namely, $\{{}_nC_{n-1}+{}_nC_{n-2}+\ldots+{}_nC_2+{}_nC_1+1\}$ levels of gradation can be obtained. Such element construction will be hereinafter referred to as "multi-value heater".

However, in the conventional construction, for all of n in number of heating elements provided for one nozzle, driving transistors corresponding to respective heating elements in one-by-one basis are required. Namely, in comparison with the nozzle density, n times greater element density is required for the transistors. In general, as the driving transistor, bipolar transistor and N-MOS transistor are employed. The element density in the nozzle direction is about 70 $\mu$m. For example, when the printing density is 360 dpi (dot/inch), about (70/n) $\mu$m of element density is required, and when the printing density is 720 dpi, about (35/n) $\mu$m of element density is required. In order to increase the element density, some measure, such as n stage structure of the driving transistor (circuit), becomes necessary. In such case, wiring becomes complicate and the size of the head substrate becomes large.

SUMMARY OF THE INVENTION

It is an object of the present invention to provide an ink-jet element substrate, an ink-jet head and an ink-jet printing apparatus which employ multi-value heater capable of achieving high gradation levels, can simplify circuit construction and permits down-sizing.

In a first aspect of the present invention, there is provided a substrate for an ink-jet element of an ink-jet printing head ejecting an ink through a plurality of ejection openings, comprising:

a plurality of heating elements provided for each. of the plurality of ejection openings and generating a thermal energy for ejecting the ink;

a data holding circuit for holding an image data for driving the heat generating elements, by holding the image data in the number of bits corresponding to the number of the ejection openings;

a driving circuit capable of driving each of the heating elements on the basis of the image data; and a selection circuit for selecting at least one of the plurality of heating elements provided corresponding to each of the ejection openings for driving.

In a second aspect of the present invention, there is provided an ink-jet printing head for ejecting an ink through a plurality of ejection openings, the ink-jet printing head comprising:

a plurality of passages respectively communicated with respective of the ejection openings, and a substrate for an ink-jet element;

the substrate for an ink-jet element comprising:

a plurality of heating elements provided for each of the plurality of ejection openings and generating a thermal energy for ejecting the ink;

a data holding circuit for holding an image data for driving the heat generating elements, by holding the image data in the number of bits corresponding to the number of ejection openings;

a driving circuit capable of driving each of the heating elements on the basis of the image data; and a selection circuit for selecting at least one of the plurality of heating elements provided corresponding to each of the ejection openings for driving.

In a third aspect of the present invention, there is provided an ink-jet printing apparatus using an ink-jet printing head capable of ejecting an ink through a plurality of ejection openings for printing an image on a printing medium, the ink-jet printing apparatus comprising:

means for relatively moving the printing head and the printing medium;

the ink-jet printing head including a plurality of passages respectively communicated with respective of the ejection opening, and a substrate for an ink-jet element;

the substrate for an ink-jet element comprising:

a plurality of heating elements provided for each of the plurality of ejection openings and generating a thermal energy for ejecting the ink;

a data holding circuit for holding an image data for driving the heat generating elements, by holding the image data in the number of bits corresponding to the number of the ejection openings;

a driving circuit capable of driving each of the heating elements on the basis of the image data; and a selection circuit for selecting at least one of the plurality of heating elements provided corresponding to each of the ejection openings for driving.

The present invention includes a plurality of heating elements for each of ink ejection openings and can obtain high gradation expression ability by selecting these for driving. Also, by providing wiring for a plurality of heating elements in common circuit construction can be simplified and downsizing of the head can be achieved.

On the other hand, by enabling selective operation of the heating element, ink ejection amount adapted to printing density can certainly obtained.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to be present invention, but are for explanation and understanding only.

In the drawings:

FIG. 7 is an explanatory illustration showing an input/output relationship of a decoder shown in FIG. 3;

FIG. 10 is an explanatory illustration showing an input/output relationship of a decoder shown in FIG. 8;

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscure the present invention.

(First Embodiment)

Figure 1:
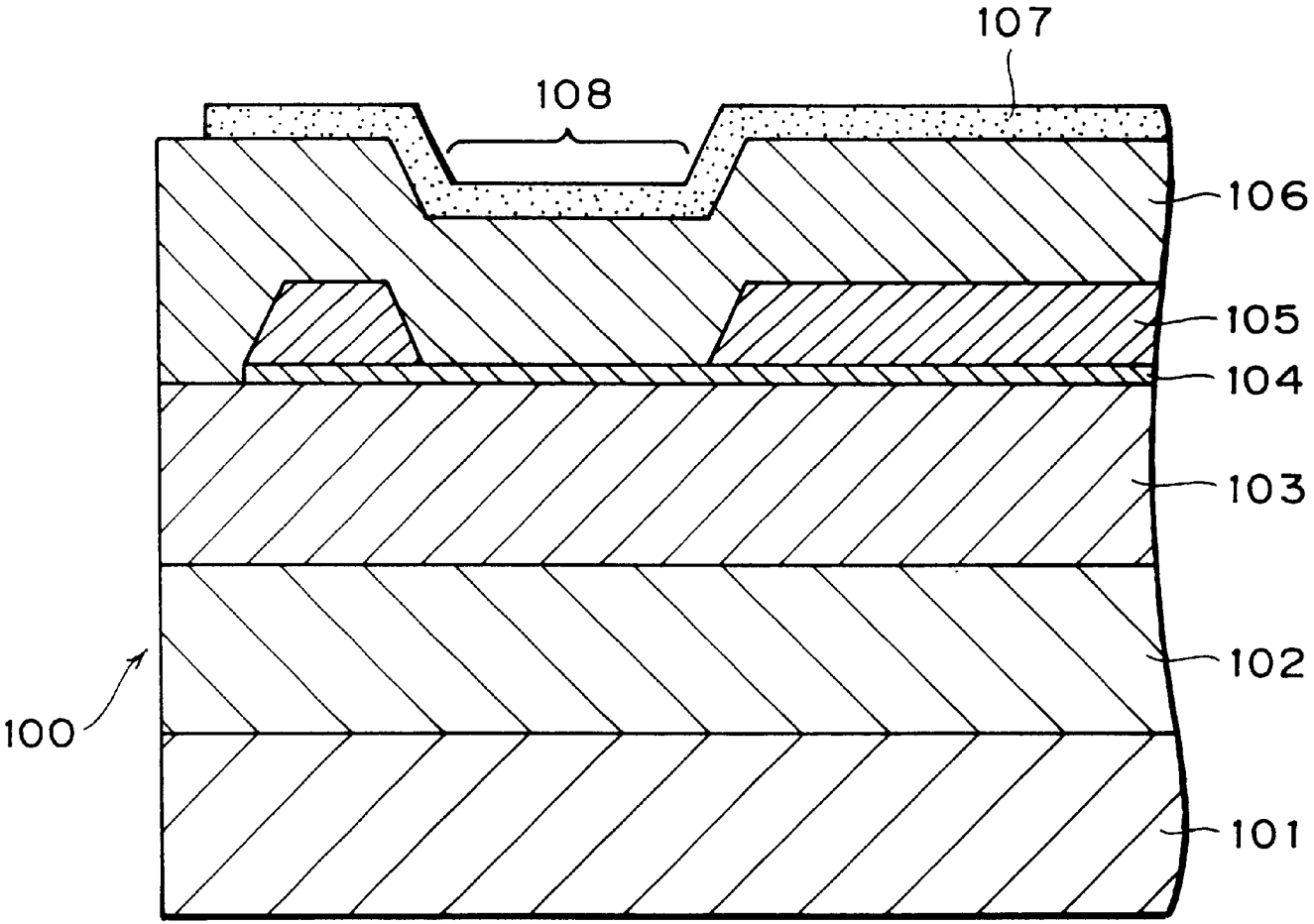
FIG. 1 is a section for explaining basic construction of an ink passage portion of a substrate of an ink-jet printing head according to the present invention.

FIG. 1 is a section showing a basic constructional portion corresponding to an ink passage of an element substrate 100 in an ink-jet printing head according to the present invention. In FIG. 1, the reference numeral 101 denotes a silicon substrate and 102 denotes a thermal oxidation layer as a heat accumulation layer. The reference numeral 103 denotes a $SiO_2$ layer or a $Si_3N_4$ layer as an interlayer insulation layer which also serves as a heat accumulation layer, 104 denotes a resistor layer, 105 denotes an electrode wiring of an Al alloy layer, such as Al or Al—Si, Al—Cu or the like, and 106 denotes a $SiO_2$ layer or a $Si_3N_4$ layer as a protective layer. The reference numeral 107 denotes an anti-cavitation layer protecting the protective layer 106 from chemical and physical impact associating with heating of the resistor layer 104. The reference numeral 108 denotes a heat acting portion receiving action of heat from a region of the resistor layer 104 where the electrode wiring 105 is not formed.

The resistor layer 104 form heating resistors (electrothermal transducers) as heating elements between the wiring 105 as electrodes. Not only the heating resistors, but also the overall resistor layer 104 contains $TaN_{0.8}$. The heating resistor containing $TaN_{0.8}$ has small fluctuation in production and can achieve satisfactory stability in function even when a plurality of heating resistors are formed on the same substrate. Furthermore, even when the power is supplied to the heating resistors in various conditions, variation of resistance is small, and respective functions of a large number of heating resistors become stable to demonstrate comparable functions relative to each other.

Figure 2:
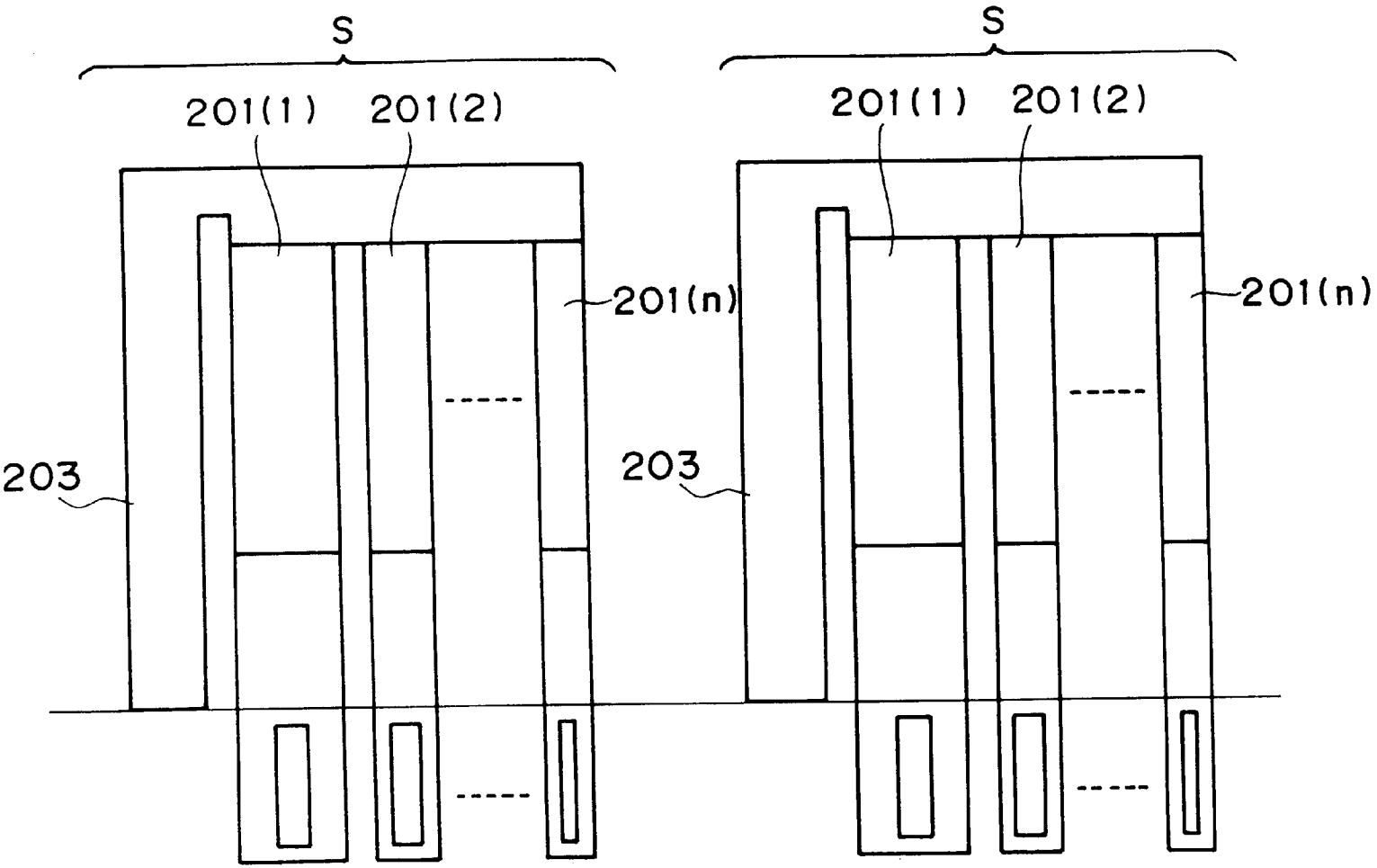
FIG. 2 is a plan view of the major portion of one embodiment of the substrate of the ink-jet printing head according to the present invention.

FIG. 2 is a plan view of the major part of a substrate for the ink-jet printing head, in which a multi-value heater is arranged utilizing construction of a substrate 100 of FIG. 1, in which is illustrated a portion corresponding to ink passages for two nozzles. The multi-value heater has a heating resistor 201 as constructional portion of FIG. 1. As the heating resistor 201, n in number of heating elements (hereinafter referred to as "heater") 201(1), 201(2), . . . , 201(n) form one set of segment S. The segment S is adapted for one nozzle. Intervals between the n in number of heaters 201(1), 201(2), . . . , 201(n) forming the multi-value heater are set to several $\mu$m. Respective of the heaters 201(1), 201(2), . . . , 201(n) are connected to driving transistors discussed later. The reference numeral 203 denotes electrode wiring supplying power to respective heaters 201(1), 201(2), . . . , 201(n).

Figure 3:
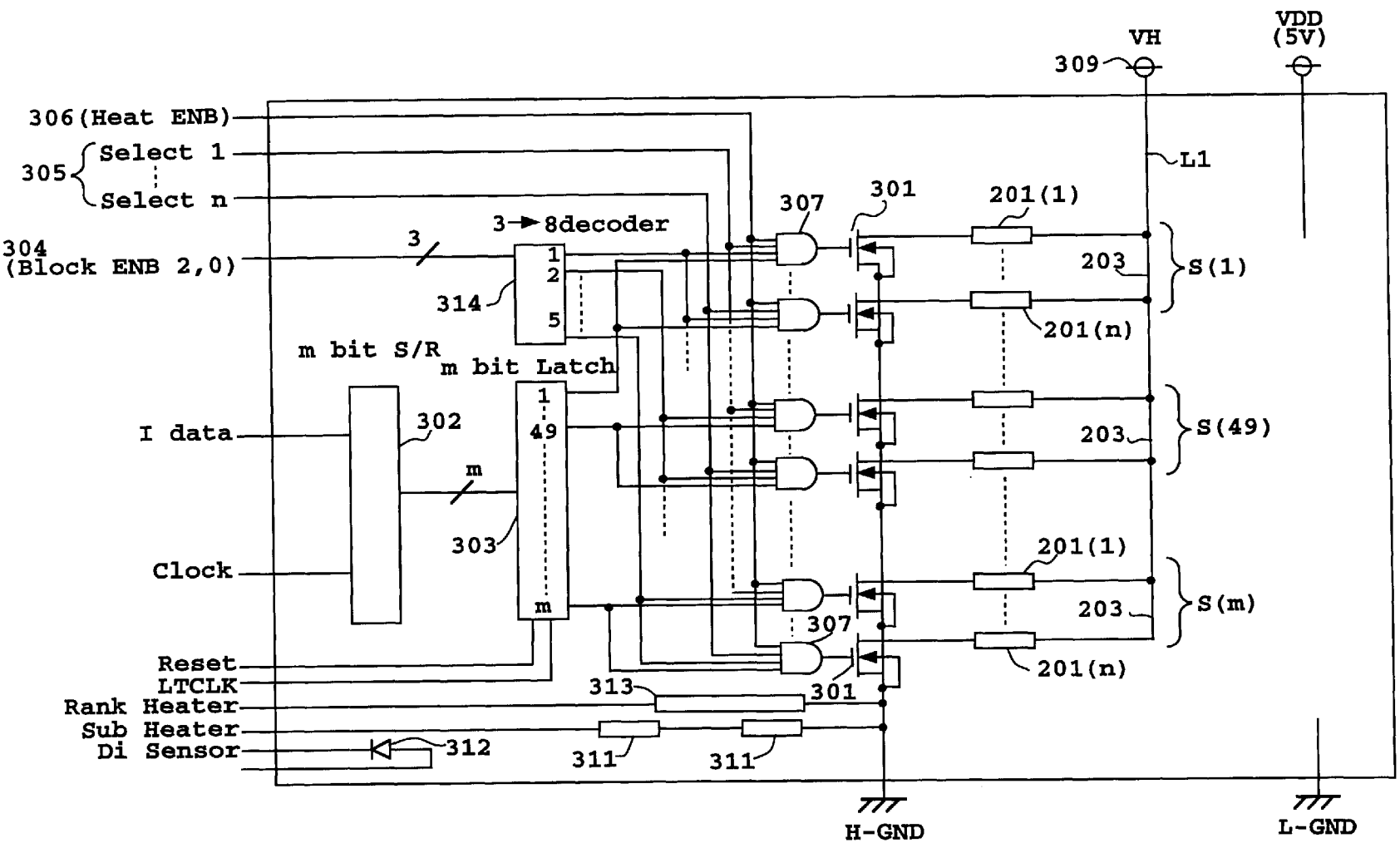
FIG. 3 is an equivalent circuit diagram of an electric circuit constructed on the substrate shown in FIG. 2.

FIG. 3 is a circuit diagram showing an equivalent circuit of an electric circuit constructed by the substrate for the head in FIG. 2. The circuit is constructed with the multi-value heater in the ink passage forming one nozzle, N-MOS transistors 301 as driving transistors independently driving the heaters 201(1), 201(2), . . . , 201(n), a shift register 302 constructed with a C-MOS transistor and for processing drive signal, a latching circuit 303 for holding data, and an AND circuit 307 connected to respective of the transistors 301. The AND circuit 307 performs logical operation of a block selection signal (Block ENB) 304 for dividing the ink passages forming the nozzles into blocks, a select signal (Select) 305, a driving pulse signal (Heat ENB) 306 and data of the latching circuit 303, and drives the corresponding transistors 301 on the basis of the results of logical operation. Here, the segment S(1) to S(m) are formed corresponding to m in number of the ink passages.

The reference numeral 203 denotes the electrode wiring set forth above (see FIG. 2) independently supply power to one ends of the heaters 201(1), 201(2), . . . , 201(n) as the multi-value heater. The electrode wiring 203 is connected to a common power source 309 via a common wiring L1. Furthermore, a temperature adjusting sub-heater 311, a temperature sensor 312 and a resistance value monitoring heater 313 for the heater are also provided.

In FIG. 3, VDD is a logic power source, H-GND is a GND for a heater driving power source 309 (VH), and L-GND is a GND for a logic power source VDD. The heater driving power source 309 is connected to the ends of all of the elements 201(1), 201(2), . . . , 201(n) of the segments S(1) to S(m) via a common wiring L1. On the other hand, the shift register 302 inputs the serial image data input signal (Idata) corresponding per segments S(1), S(2), . . . , S(m) and the clock input signal (Clock) for driving the shift register 302, and outputs a parallel signal of the image data to the latching circuit 303. In the latching circuit 303, a reset signal (Reset) and a latching signal (LTCLK) are input, the image data input from the shift register 302 is temporarily stored and then output to the AND circuit 307 per corresponding segments S(1), S(2), . . . , S(m). The driving pulse signal (Heat ENB) 306 is input to the AND circuit 307 per respective heaters 201(1), 201(2), . . . , 201(n) of the segments S(1), S(2), . . . , S(m).

In FIG. 3, the select signal 305 is input from input terminals 1 to n (Select 1 to n) commonly corresponding to the segments S(1) to S(m). Accordingly, in accordance with this select signal 305, it is possible to select which one(s) should be driven to be heated among the heating elements 201(1) to 210(n) in each of segments 201(1) to 201(m). As set forth above, according to the present invention, the selection circuit for performing selection which of the heating element is to be driven, is provided integrally with the substrate of the head. Therefore, when number of the heating elements on the substrate for the head is large, the circuit construction on the substrate for the head can be simplified. Furthermore, the transfer signal on the substrate for the head can be reduced.

In FIG. 3, the reference numeral 314 denotes a decoder. To the input terminals 1, 2 and 3 of the decoder 314, the block selection signal 304 is input as shown in FIG. 7. Five output terminals of the decoder 314 are connected to the AND circuit 307 per the segments S(1) to S(m), separately. For example, when number of segments S are two hundreds, i.e. S(1) to S(200), namely, number of nozzles is two hundreds, five output terminals of the decoder 314 is connected as follow. Namely, among the five output terminals of the decoder 314, the first output terminal is connected to the AND circuits 307 of the segments S(1) to S(40) corresponding to nozzle numbers 1 to 40, respectively. Similarly, the second output terminal is connected to the AND circuits 307 of the segments S(41) to S(80) corresponding to nozzle numbers 41 to 80, respectively, the third output terminal is connected to the AND circuits 307 of the segments S(81) to S(120) corresponding to nozzle numbers 81 to 120, respectively, the fourth output terminal is connected to the AND circuits 307 of the segments S(121) to S(160) corresponding to nozzle numbers 121 to 160, respectively, and the fifth output terminal is connected to the AND circuits 307 of the segments S(161) to S(200) corresponding to nozzle numbers 161 to 200, respectively.

When the decoder 314 is connected as set forth above, corresponding to the block selection signal 304, nozzle groups of the five blocks separately connected to five output terminals of the decoder 314 are selected as heat nozzles ejecting the ink. Accordingly, ejection timing of the ink can be controlled per the five blocks of nozzle groups.

The circuit elements in FIG. 3 are formed on a Si substrate by semiconductor technology. Furthermore, a head acting portion 108 shown in FIG. 1 is formed on the same substrate.

Figure 4:
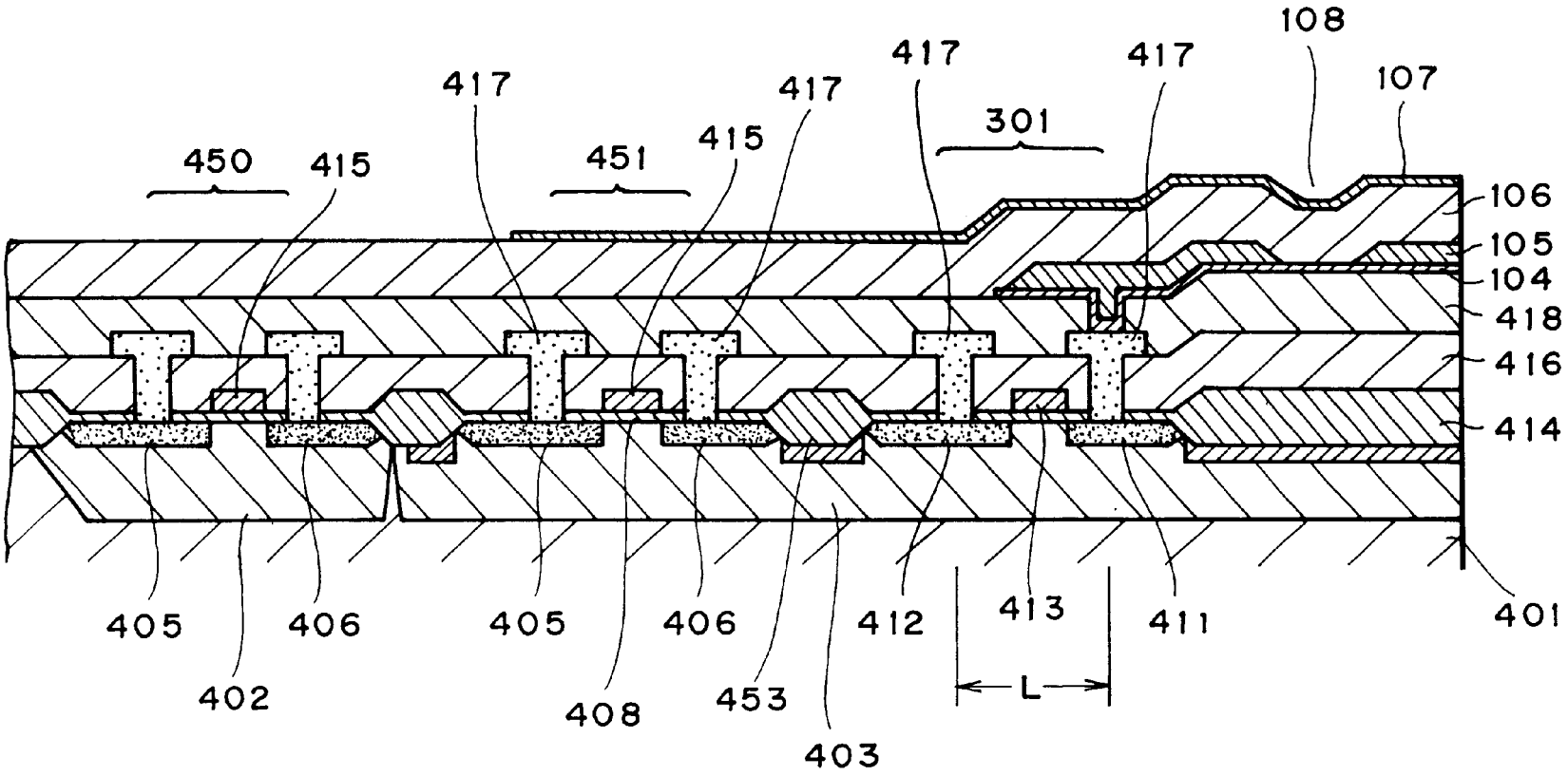
FIG. 4 is a section showing the major part of the substrate shown in FIG. 2.

FIG. 4 shows a diagrammatic section of the section cutting the primary element long longitudinal axis, in FIG. 3.

On a P-type Si substrate 401, a P-MOS 450 is formed on a N-type well region 402 by impurity implantation, such as ion implantation or the like and diffusion employing a general MOS process. On a P-type well region 403, a N-MOS 451 is formed. Each of the P-MOS 450 and the N-MOS 451 is constructed with a gate wiring 415 of poly-Si (polycrystalline silicon) deposited in a thickness more than or equal to 4000 Å and less than or equal to 5000 Å by CVD method via a gate insulation layer 408 of the thickness of several hundreds Å, a source region 405 and a drain region 406 doped with N type or P type impurity. With these P-MOS 450 and the N-MOS 451, a C-MOS logic circuit is constructed.

On the other hand, the N-MOS transistor 301 for driving elements is constructed with a drain region 411, a source region 412 and a gate wiring 413. The drain region 411 and the source region 412 are formed on the P-type well region 402 formed by a process of impurity implantation, diffusion and the like.

Here, when the N-MOS transistor 301 is employed as element driver, a distance L between drain gates forming one transistor becomes about 10 $\mu$m at the minimum value. Breakdown of 10 $\mu$m is the width of two contacts 417 of the source and drain. The width of two contacts 417 is 2×2 $\mu$m. These contact 417 become common to adjacent transistors. Accordingly, a width of 2 $\mu$m of ½ of the width of 2×2 $\mu$m is included in the distance L. In addition to the breakdown of the distance L of 10 $\mu$m becomes 4 $\mu$m of 2×2 $\mu$m of two spaces between the contact 417 and the gate 413, and the width of 4 $\mu$m of the gate 413. In total of these breakdown, the distance L becomes 10 $\mu$m.

Between respective elements on the substrate 401, an oxide film isolation region 453 is formed by field oxidation in the thickness more than or equal to 5000 Å and less than or equal to 10000 Å, and the elements are isolated. The field oxide layer acts as heat accumulation layer 414 of first layer, below the heat acting portion 108.

On the substrate 401 after formation of respective elements, an interlayer insulation layer 416, such as PSG film, BPSG film or the like, is deposited in a thickness about 7000 Å by CVD method. Then, the insulation layer 416 is planarized by heat treatment or the like. Subsequently, via the contact hole, wiring is performed by the contact (Al electrode) 417 by the first wiring layer. Then, an interlayer insulation layer 418 of $SiO_2$ layer or the like is deposited by plasma CVD method in a thickness more than or equal to 10000 Å and less than or equal to 15000 Å. Also, through a through hole, $TaN_{0.8}$ hex layer as the resistor layer 104, in a thickness of about 1000 Å is formed by DC sputtering method. Subsequently, an Al electrodes 105 of a second wiring layer to be the wiring to respective elements 201(1), 201(2), . . . , 201(n) formed by the resistor layer 104, are formed.

Next, as the protective layer 106, $Si_3N_4$ is deposited in a thickness of 10000 Å by plasma CVD method. Also, on the uppermost layer, the anticavitation layer 107 of Ta or the like is deposited in the thickness of about 2500 Å.

Subsequently, the substrate 100 of the printing head constructed as set forth above, is formed into an ink-jet printing head 510 by forming ejection openings 500 for ejecting the ink, or the like. Namely, an ink passage wall 501 is formed on the substrate 100, the printing head 510 is constructed with the substrate 100 and an upper plate 502.

The ink for printing is supplied into a common liquid chamber 504 of the printing head 510 via a supply tube 503 from a not shown storage chamber. The ink supplied into the common liquid chamber 504 is supplied into the ink passages 505 by capillary phenomenon, and is stably held by formation of meniscus at the ejection openings 500. By applying power to the elements 201(1), 201(2), . . . , 201(n) positioned within the heat generating portion (heat acting portion) 108 within the ink passage 505, the ink within the heat generating portion 108 is heated to cause bubbling. By energy of bubbling, ink droplets are ejected from the ejection openings 500. With such constriction, the ejection openings 500 are arranged in high density of 400 dpi to form the ink-jet printing head 510 of multi ejection openings.

Figure 6:
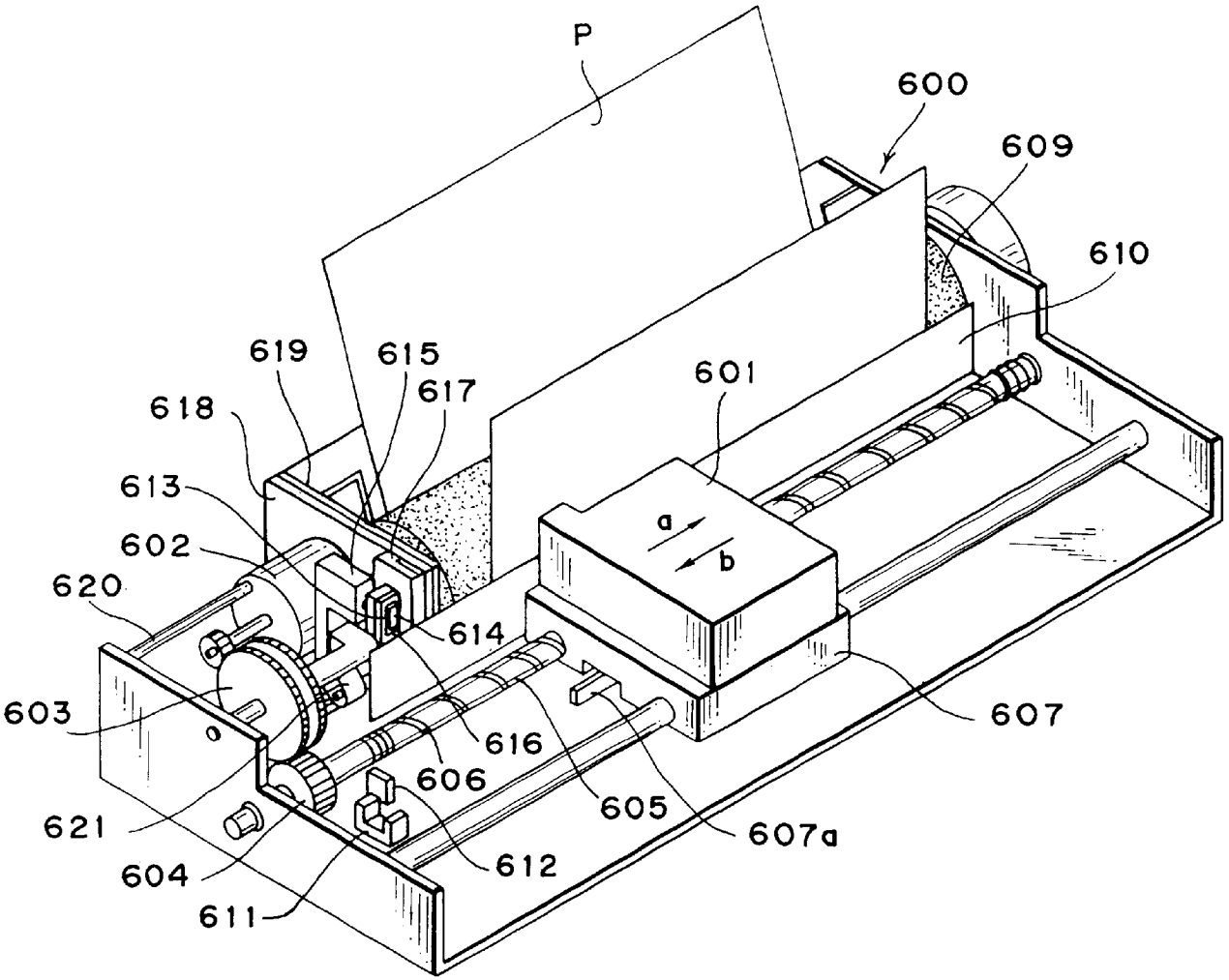
FIG. 6 is a perspective view of one embodiment of the ink-jet printing apparatus according to the present invention.

FIG. 6 is a general perspective view showing one example of an ink-jet printing apparatus which can utilize the above-mentioned ink-jet printing head 510.

In FIG. 6, the reference numeral 601 denotes a printing head constructed similarly to the foregoing ink-jet printing head 510. The head 601 is mounted on a carriage 607. The carriage 607 is engaged with a spiral groove 606 of a lead screw 605. The lead screw 605 is driven in forward and reverse directions by a reversible motor 602 via driving force transmission gears 603 and 604. By the driving torque of the driving motor 602, the head 601 is reciprocally moved in the directions of arrows a and b along a guide 608. Also, by not shown printing medium supply device, a printing paper P transported over a platen 409 is held on the platen 609 by a paper holding plate 610 along the moving direction of the carriage 607.

Figure 5:
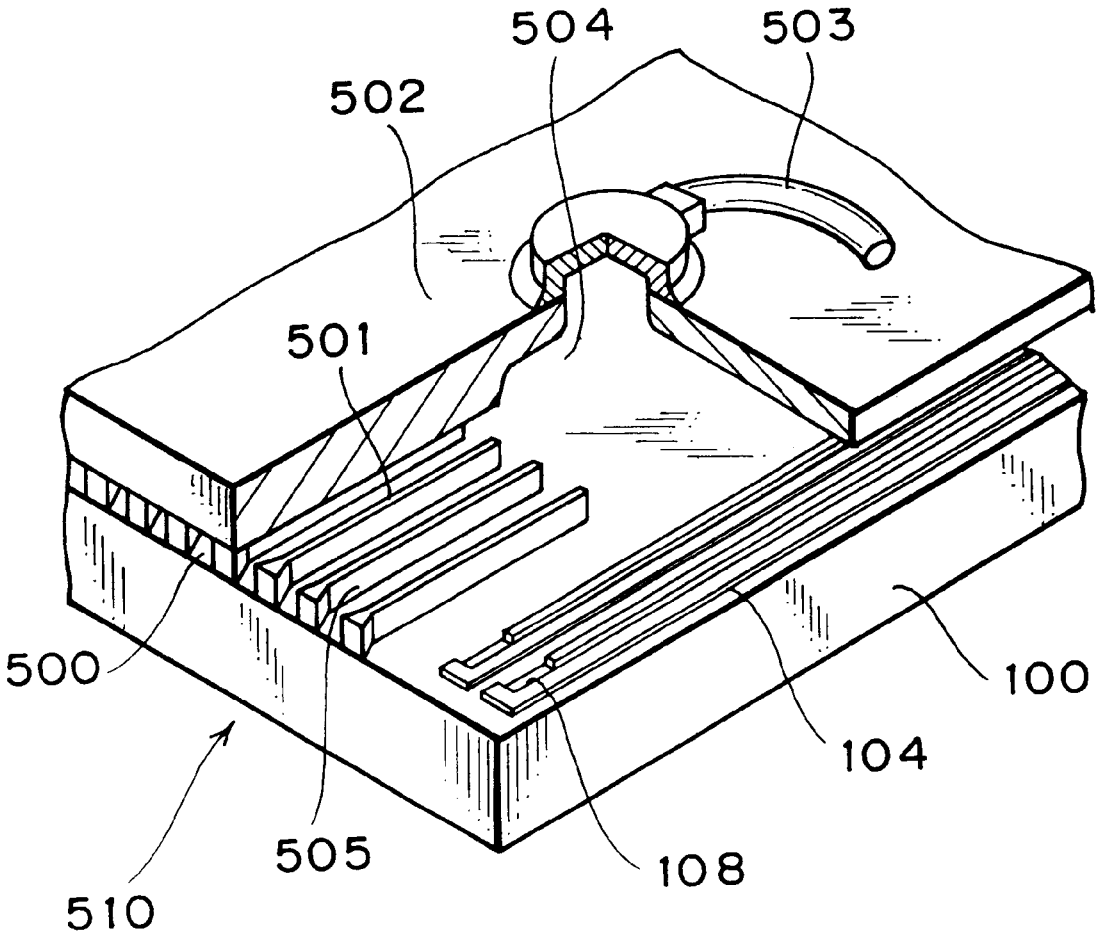
FIG. 5 is a partially cut-out perspective view of one embodiment of the ink-jet printing head according to the present invention.

In the vicinity of one end of the lead screw 605, photo-couplers 611 and 612 are arranged. The photo-couplers 611 and 612 form a home position detecting means which confirm presence of lever 607*a* of the carriage 607 at their arrangement positions and performs switching of revolution direction of the driving motor 602, and the like. The reference numeral 613 denotes a supporting member for supporting a cap member 614 covering the front face where the ejection openings of the ink-jet printing head 601 are formed. To the cap member 614, the ink not contributing printing of the image is ejected (non-print ejection). The non-print ejection is performed in order to maintain the ink ejection performance of the head 601. The reference numeral 615 is an ink suction means for sucking an ink accumulated within the cap member 614 by the non-print ejection and the like. By this suction means 615, suction recovery is performed via an opening portion 616 of the cap member 614 for sucking ink from the ejection openings in order to maintain the ink ejection performance of the head 601. The reference numeral 617 denotes a cleaning blade, 618 denotes a moving member which can move the blade 617 in back and forth direction (direction perpendicular to the moving direction of the carriage 607). These blade 617 and the moving member 618 are supported by a main body support body 619. The blade 617 is not specified to the shown form but can be of any known cleaning blade. The reference numeral 620 denotes a lever for initiating suction of the suction recovery, which is moved by a driving force from the driving motor 602 via a known transmission means, such as a cam 621, clutch or the like. An ink-jet printing control portion for providing signals to the heating elements 201(1), 202(2), . . . , 202(n) within the ink passage 505 of the head 601 (see FIG. 5), or performing driving control of respective of foregoing mechanisms, is provided at the main body side of the printing apparatus of FIG. 6, which printing control portion is not shown.

In the ink-jet printing apparatus constructed as set forth above, with respect to the printing paper P transported over the platen 609 by not shown printing medium feeding device, printing is performed by reciprocally moving the head 601 over the entire width of the paper P.

The present invention includes a plurality of heating elements for each of ink ejection openings and can obtain high gradation expression ability by selecting these for driving. Also, by providing wiring for a plurality of heating elements in common circuit construction can be simplified and downsizing of the head can be achieved.

On the other hand, by enabling selective operation of the heating element, ink ejection amount adapted to printing density can certainly obtained.

(Second Embodiment)

Figure 8:
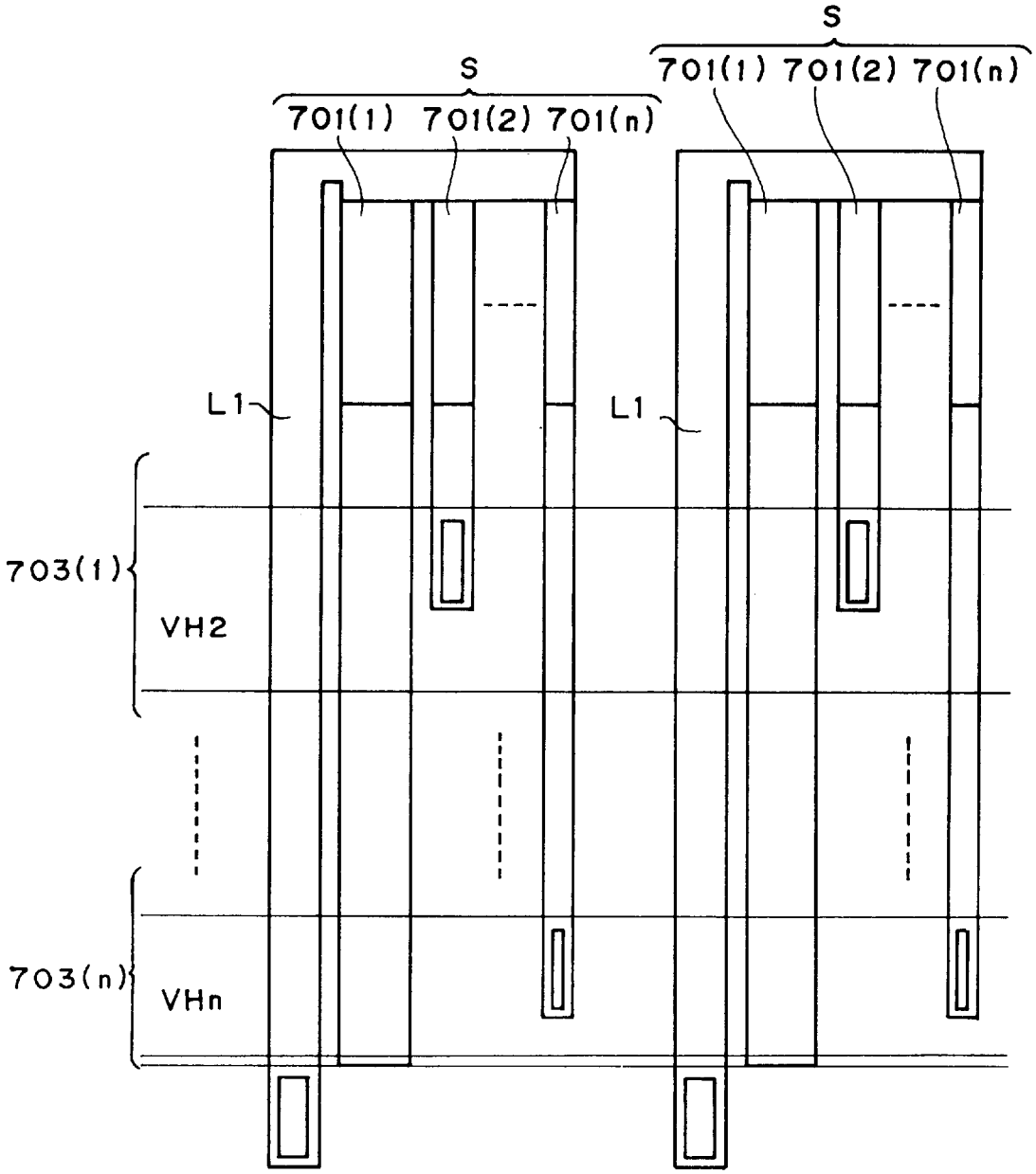
FIG. 8 is a plan view of the major portion of another embodiment of a substrate of the ink-jet printing head according to the present invention.
Figure 9:
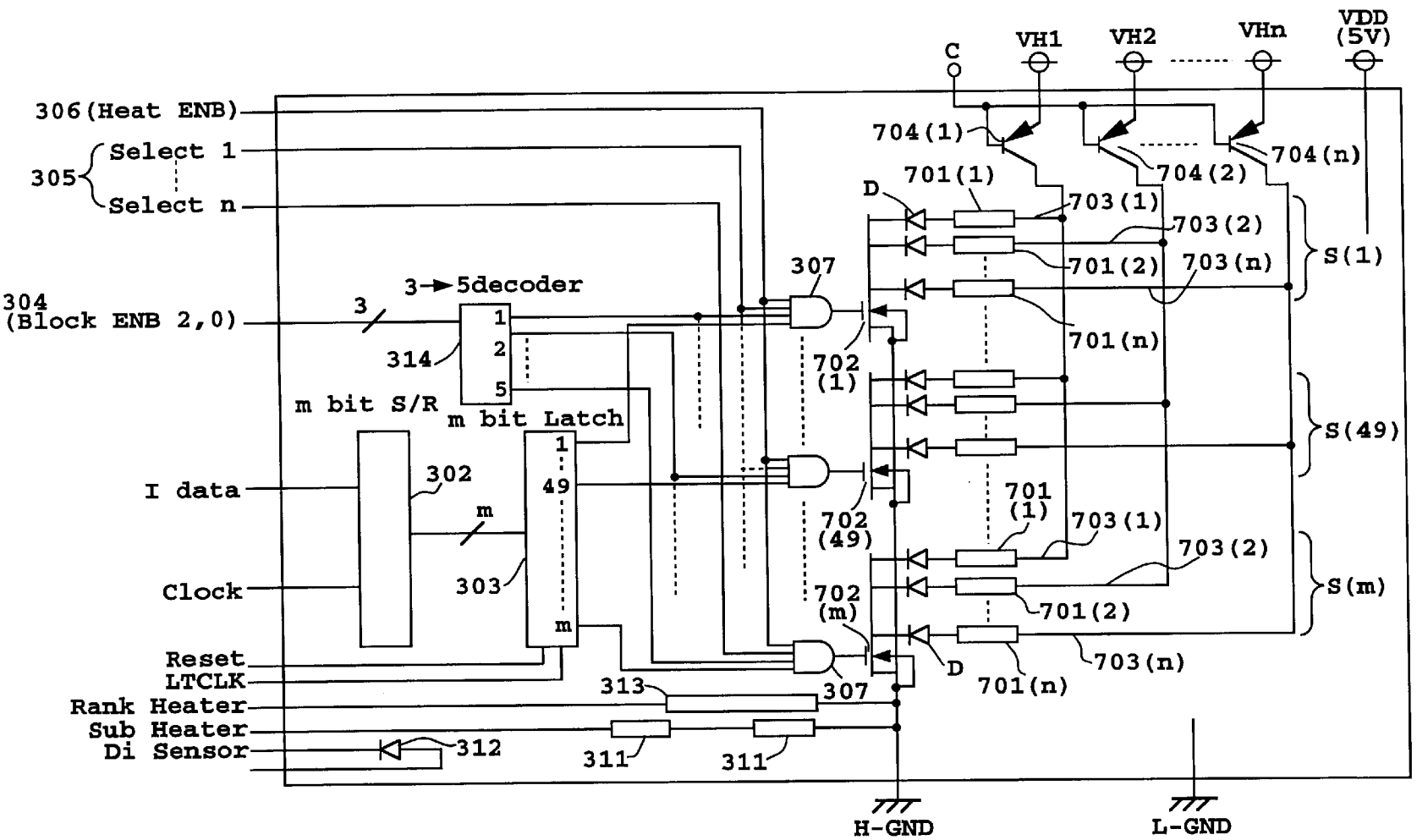
FIG. 9 is an equivalent circuit diagram of an electric circuit constructed on the substrate shown in FIG. 8.

FIG. 8 is a plan view of the major portion of the second embodiment of the element substrate in the ink-jet printing head of the present invention, in which a multi-value heater is arranged utilizing the construction of the substrate of FIG. 1. In FIG. 8, a portion corresponding to the ink passage for two nozzles are shown. The multi-value heater includes a heating resistor 701 as a component of FIG. 1. As the heating resistor 701, n in number of heating elements 701(1), 701(2), . . . , 701(n) are formed. These heating elements 701(1), 701(2), . . . , 701(n) form a one set of segment S. The segment S is for one nozzle. Interval between n in number of heating elements 701(1), 701(2), . . . , 701(n) forming the multi-value heater, is several $\mu$m. In respective segments S(1) . . . S(m), one end of the elements 701(1), 701(2), . . . , 701(n) is connected to the same driving transistors 702(1), 702(2), . . . , 702(m) via a diode D as shown in FIG. 9. The reference numerals 703(1) . . . 703(m) are electrode wiring for supplying power to respective elements 701(1) . . . 701(n).

FIG. 9 is an equivalent circuit of an electric circuit formed by the substrate shown in FIG. 8. Like components to those in FIG. 3 will be identified like reference numerals and the description thereof will be neglected for simplification of disclosure. The reference numerals 704(1) . . . 704(n) are transistors operated by control signal C. With respect to the elements 701(1) . . . 701(n) of the segments S(1) . . . S(m), the heater driving voltages VH1 . . . VH(n) can be applied by the transistors. The voltages VH1 . . . VH(n) are set at voltages corresponding to the heat generation amount of the elements 701(1) . . . 701(n).

The present invention includes a plurality of heating elements for each of ink ejection openings and can obtain high gradation expression ability by selecting these for driving. Also, by providing wiring for a plurality of heating elements in common circuit construction can be simplified and downsizing of the head can be achieved.

On the other hand, by enabling selective operation of the heating element, ink ejection amount adapted to printing density can certainly obtained.

(Third Embodiment)

In the shown embodiment, in the embodiment of foregoing FIG. 3, the select signal 305 is Select 1, 2, and the wiring for the output terminal of the decoder 314 is modified, the printing head of total 160 nozzles having heaters 2*a* and 2*b* as respective large and small heating elements, is controlled. The number nozzles corresponds to number of the segment S. In case of 160 nozzles, number of segments S becomes 160 of S(1) to S(160).

The Select 1 of the select signal 305 is input to the AND circuit 307 corresponding to respective heater 2*a* of the segments S(1) to S(160). The Select 2 is input to the AND circuit 307 corresponding to respective heater 2*b* of the segments S(1) to S(160).

On the other hand, the block selection signal 304 is input to the input terminals 1, 2 and 3 of the decoder 314, as shown in FIG. 10. The five output terminals of the decoder 314 are separately connected to respective the AND circuits 307 per the segments S(1) to S(160). Among the five output terminals, the first output terminal is connected to respective of the AND circuits 307 of the segments S corresponding to the nozzle numbers 1 to 8, 41 to 48, 81 to 88 and 121 to 128. The second output terminal is connected to respective of the AND circuits 307 of the segments S corresponding to the nozzle numbers 9 to 16, 49 to 56, 89 to 96 and 129 to 136. The third output terminal is connected to respective of the AND circuits 307 of the segments S corresponding to the nozzle numbers 17 to 24, 57 to 64, 97 to 104 and 137 to 144. The fourth output terminal is connected to respective of the AND circuits 307 of the segments S corresponding to the nozzle numbers 25 to 32, 65 to 72, 105 to 112 and 145 to 152. The fifth output terminal is connected to respective of the AND circuits 307 of the segments S corresponding to the nozzle numbers 33 to 40, 73 to 80, 113 to 120 and 153 to 160. Thus connecting the decoder 314, corresponding to the block selection signal 304, the nozzle group of five blocks separately connected to the five output terminals of the decoder 314 are selected as heat nozzles for performing ejection of the ink.

Figure 11A:
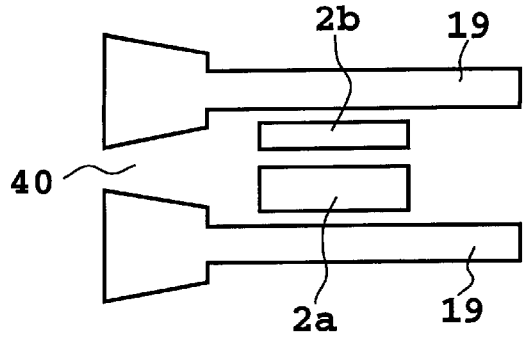
FIGS. 11A, 11B and 11C are explanatory illustrations showing ejection forms of ink in the referred embodiment of the ink-jet printing head according to the present invention.
Figure 11B:
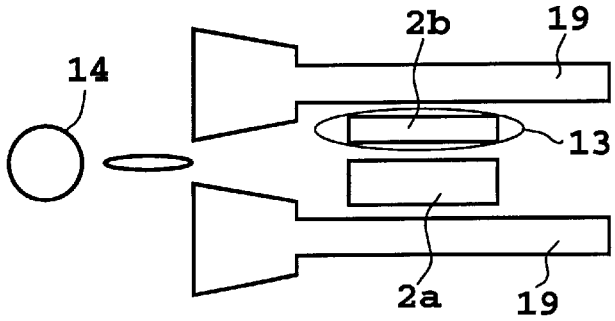
Figure 11C:
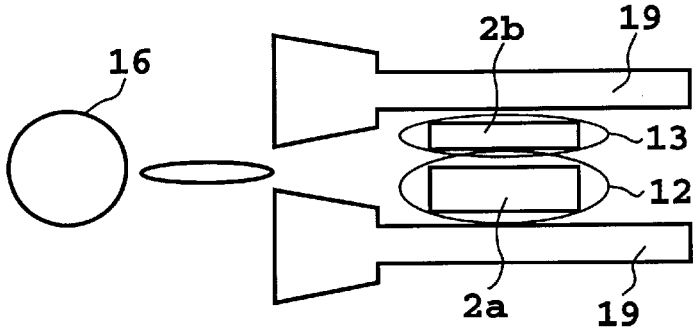

FIGS. 11A to 11C show examples of ink ejection. In the shown embodiment, as heater 201 for one nozzle, heaters 2*a* and 2*b* having different heat generation amount are provided. Hereinafter, the heater 2*a* having large heat generation amount will be referred to as "large ejection heater" and the heater 2*b* having small heat generation amount will be referred to as "small ejection heater".

In FIGS. 11A to 11C, the ink is filled in the ejection nozzle defined by the nozzle wall 19. In FIGS. 11B and 11C, the ink is heated to cause bubbling by ejection heaters 2*a* and 2*b*. The ink is ejected from the orifice 40 by bubbling pressure. FIG. 11B shows a condition where the ink is heated to generate bubble by the small ejection heater 2*b* and a small droplet 14 of the ink is ejected by a small bubble 13. At this time, the ink ejection amount becomes about 20 ng. FIG. 11C shows the condition where the ink is heated and bubbled by the small ejection heater 2*b* and the large ejection heater 2*a*. At this time, the ink ejection amount becomes 80 ng. In FIG. 11C, a large droplet 16 of the ink is ejected by the small bubble 13 and the large bubble 12. The large bubble 12 is generated by the large ejection heater 2*a*.

The ink ejection amount 20 ng is adapted to high printing density of 720 dpi, and the ink ejection amount 80 ng is adapted to printing density of 360 dpi.

Figure 12:
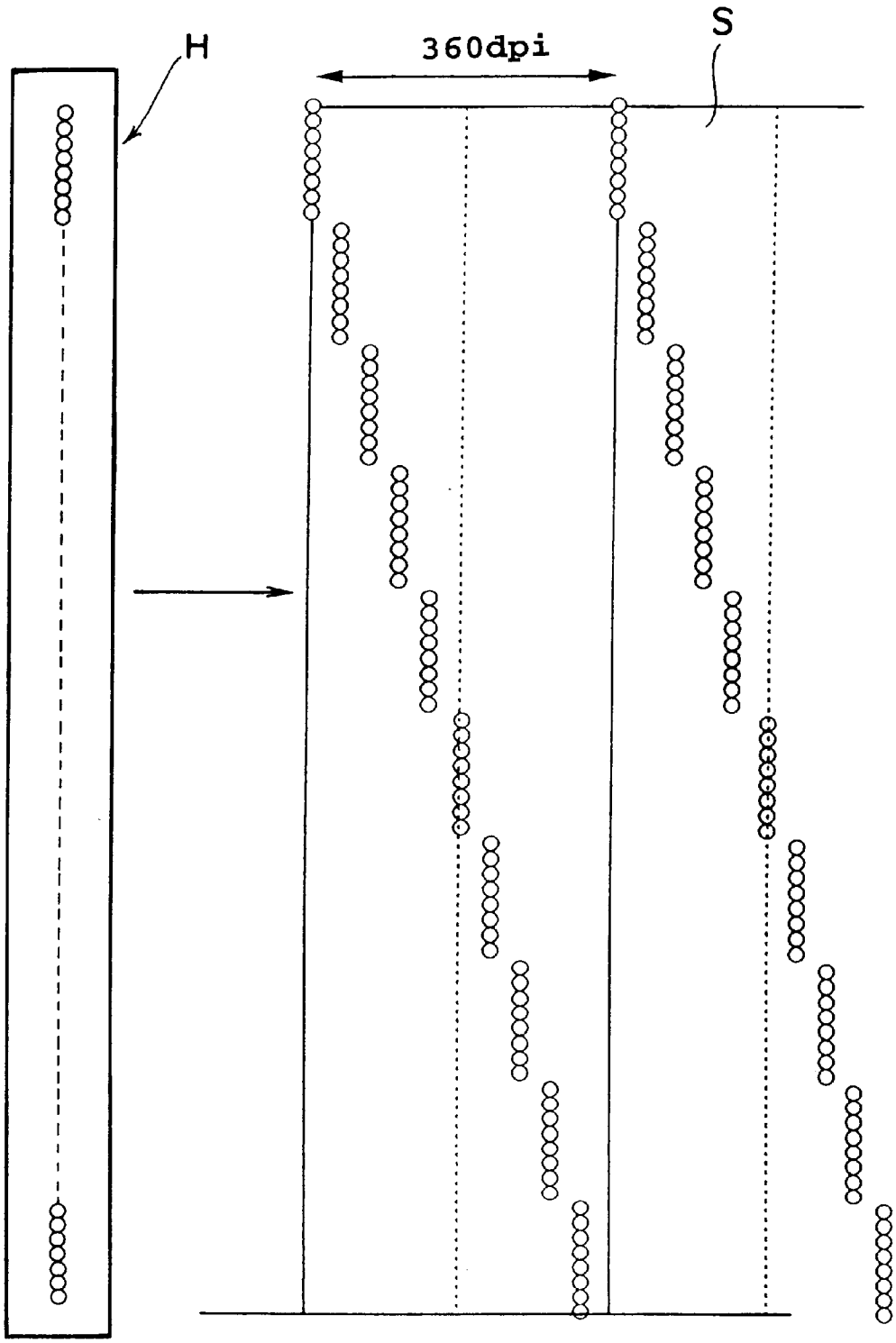
FIG. 12 is an explanatory illustration showing a relationship between an ink ejection form of FIG. 11C and a printing density.
Figure 13:
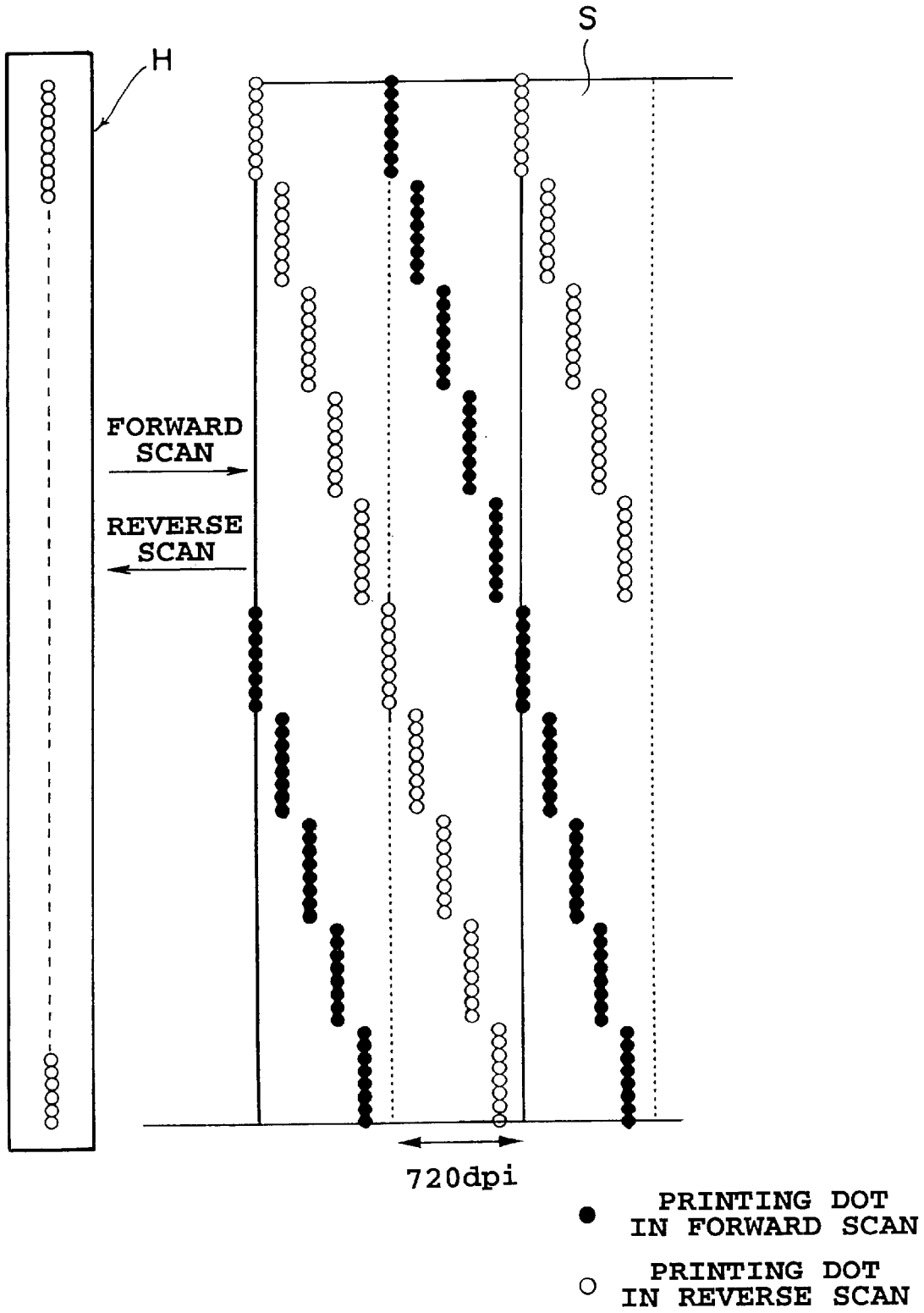
FIG. 13 is an explanatory illustration showing a relationship between an ink ejection form of FIG. 11B and a printing density.

FIGS. 12 and 13 are explanatory illustrations of hitting positions of the ink droplet on a printing medium S in case of printing of image at printing densities of 360 dpi and 720 dpi in a scanning system employing the printing apparatus 600 shown in FIG. 6, respectively. In these drawings, H denotes a printing head forming an image on the printing medium S by scanning in the arrow direction. In FIGS. 12 and 13, for convenience of description, number of nozzle is assumed to be 80 and ink ejection timing is controlled by dividing the nozzles into 10 blocks respectively having 8 nozzles.

In case of printing at the printing density of 360 dpi as shown in FIG. 12, as shown in FIG. 11C, control is performed for certainly adapted to the ink ejection amount 80 ng of the printing density. On the other hand, in case of printing at the printing density of 720 dpi as shown in FIG. 13, as shown in FIG. 11B, control is performed for certainly adapted to the ink ejection amount 20 ng of the printing density. In FIG. 13, hollow circles on the printing medium S represent hitting position of the ink droplet ejected in the forward scan, and solid circles on the printing medium S represent hitting position of the ink droplet ejected in the reverse scan.

Figure 14:
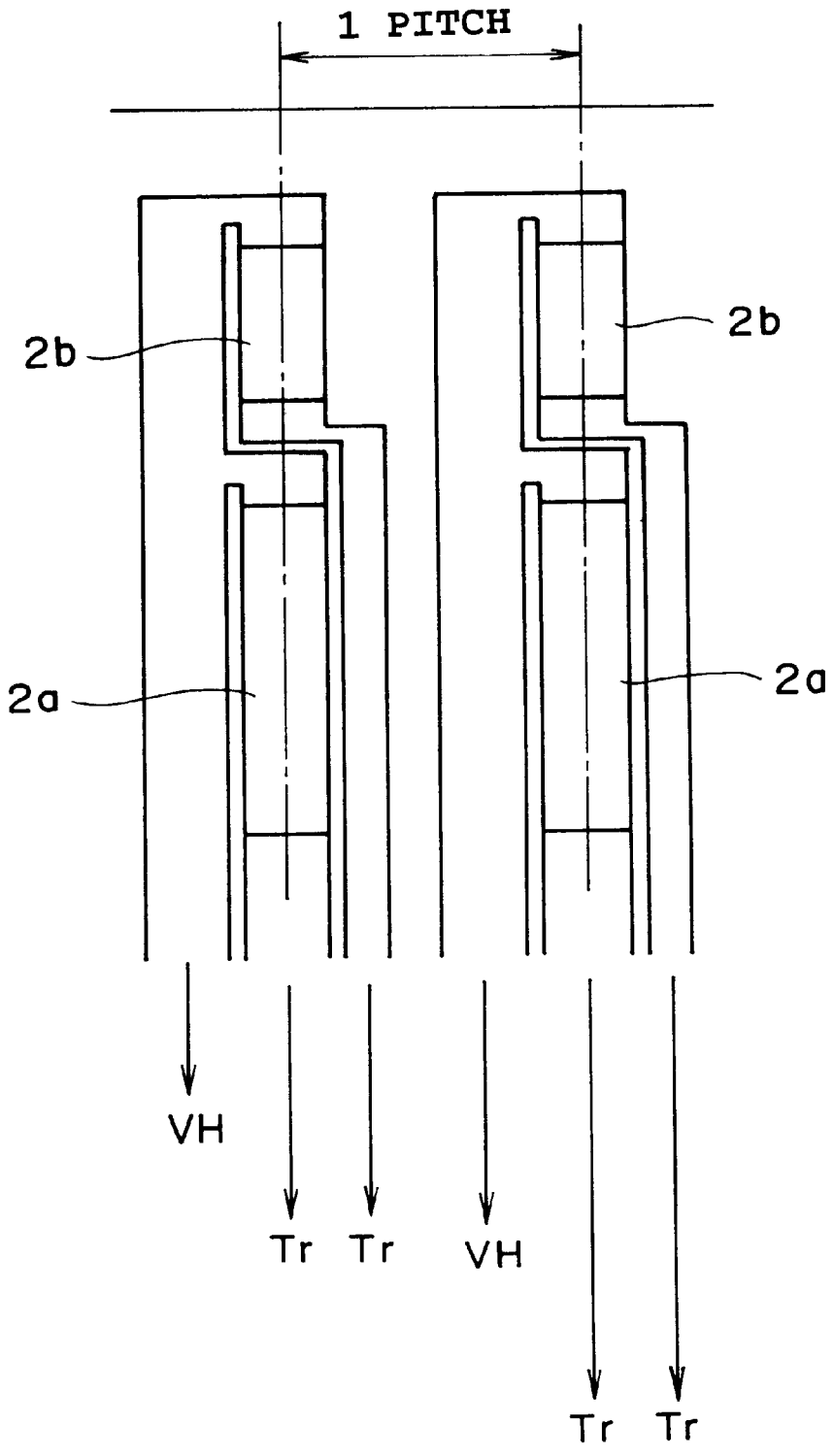
FIG. 14 is an explanatory illustration showing another arrangement of heating elements in the preferred embodiment of the ink-jet printing head according to the present invention.

FIG. 14 shows another example of the arrangement of the heating elements. In the shown embodiment, the foregoing heaters 2*a* and 2*b* are arranged along the ink ejection direction (upward in FIG. 14). One end side of the heaters 2*a* and 2*b* are connected to the side of the heater driving power source 309 (see FIG. 3) of the power source voltage VH via the common wiring. The other end sides of the heaters 2*a* and 2*b* are connected to the side of the corresponding driving transistor 201 (shown as "Tr" in FIG. 14). Accordingly, in the shown embodiment, the aligning direction of the heating element (vertical direction of FIG. 14) and the aligning direction of the transistors 201 (lateral direction of FIG. 14) are perpendicular to each other. In this connection, in the arrangement form as shown in FIGS. 11A to 11C, alignment direction of the heating elements and the aligning direction of the transistors become parallel.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A substrate for an ink-jet element of an ink-jet printing head ejecting an ink through a plurality of ejection openings, comprising:

a plurality of heating elements provided for each of said plurality of ejection openings and generating a thermal energy for ejecting the ink;

a data holding circuit for holding an image data for driving said heating elements, by holding said image data whose bits are the same in number as said ejection openings;

a selection circuit for selecting at least one of said plurality of heating elements provided corresponding to each of said ejection openings for driving; and a driving circuit for driving said heating elements selected by said selection circuit based on said image data corresponding to each of said ejection openings.

2. A substrate for an ink-jet element as set forth in claim 1, wherein said data holding circuit and said selection circuit are integrally built-in in said substrate for the ink-jet element.

3. A substrate for an ink-jet element as set forth in claim 1, wherein said driving circuit is provided on a one-by-one basis relative to said plurality of heating elements.

4. A substrate for an ink-jet element as set forth in claim 1, wherein said driving circuit is provided per each of said ejection openings corresponding to said plurality of heating elements.

5. A substrate for an ink-jet element as set forth in claim 1, wherein respective first ends of said heating elements are electrically connected to a wiring for a power supply.

6. A substrate for an ink-jet element as set forth in claim 5, wherein, in said wiring for the power supply, a switching element operable depending upon a control signal for driving said heating elements is provided.

7. A substrate for an ink-jet element as set forth in claim 1, which further comprises a common wiring electrically connected to said plurality of heating elements and, in said common wiring, a switching element operable depending upon a drive signal for driving said heating elements.

8. A substrate for an ink-jet element as set forth in claim 1, wherein said plurality of heating elements provided corresponding to each of said ejection openings are differentiated in heat generation amount relative to each other.

9. A substrate for an ink-jet element as set forth in claim 8, wherein each of said plurality of heating elements has a wiring connecting portion having an area depending upon a respective heat generation amount.

10. A substrate for an ink-jet element as set forth in claim 1, wherein said driving circuit includes an N-MOS transistor.

11. A substrate for an ink-jet element as set forth in claim 1, wherein said selection circuit is a circuit for supplying a selection signal corresponding to respective ones of said plurality of heating elements per each of said ejection openings.

12. A substrate for an ink-jet element as set forth in claim 1, wherein said selection circuit is a circuit supplying a selection signal depending upon a printing density of an image to be printed.

13. A substrate for an ink-jet element as set forth in claim 1, wherein said driving circuits are arranged along an aligning direction of said heating element.

14. A substrate for an ink-jet element as set forth in claim 1, wherein said driving circuits are aligned in a direction intersecting an alignment direction of said heating elements.

15. A substrate for an ink-jet element as set forth in claim 1, wherein said heating element is an electrothermal transducer.

16. A substrate for an ink-jet element according to claim 1, wherein said plurality of heating elements provided for each of said plurality of ejection openings are divided into a plurality of groups, and said selection circuit selects at least one of said groups for driving.

17. A substrate for an ink-jet element according to claim 1, wherein the number of the bits is smaller than the total number of said heating elements.

18. An ink-jet printing head for ejecting an ink through a plurality of ejection openings, said ink-jet printing head comprising:

a plurality of passages respectively communicated with respective of said ejection openings, and a substrate for an ink-jet element;

said substrate for an ink-jet element comprising:

a plurality of heating elements provided for each of said plurality of ejection openings and generating a thermal energy for ejecting the ink;

a data holding circuit for holding an image data for driving said heating elements, by holding said image data whose bits are the same in number as ejection openings;

a selection circuit for selecting at least one of said plurality of heating elements provided corresponding to each of said ejection openings for driving; and a driving circuit for driving said heating elements selected by said selection circuit based on said image data corresponding to each of said ejection openings.

19. An ink-jet printing head as set forth in claim 18, wherein said data holding circuit and said selection circuit are integrally built-in in said substrate for the ink-jet element.

20. An ink-jet printing head as set forth in claim 18, wherein said driving circuit is provided on a one-by-one basis relative to said plurality of heating elements.

21. An ink-jet printing head as set forth in claim 18, wherein said driving circuit is provided per each of said ejection openings corresponding to said plurality of heating elements.

22. An ink-jet printing head as set forth in claim 18, wherein respective first ends of said heating elements are electrically connected to a wiring for a power supply.

23. An ink-jet printing head as set forth in claim 22, wherein, in said wiring for the power supply, a switching element operable depending upon a control signal for driving said heating elements is provided.

24. An ink-jet printing head as set forth in claim 18, which further comprises a common wiring electrically connected to said plurality of heating elements and, in said common wiring, a switching element operable depending upon a drive signal for driving said heating elements.

25. An ink-jet printing head as set forth in claim 18, wherein said plurality of heating elements provided corresponding to each of said ejection openings are differentiated in heat generation amount relative to each other.

26. An ink-jet printing head as set forth in claim 25, wherein each of said plurality of heating elements has a wiring connecting portion having an area depending upon a respective heat generation amount.

27. An ink-jet printing head as set forth in claim 18, wherein said driving circuit includes an N-MOS transistor.

28. An ink-jet printing head as set forth in claim 18, wherein said selection circuit is a circuit for supplying a selection signal corresponding to respective ones of said plurality of heating elements per each of said ejection openings.

29. An ink-jet printing head as set forth in claim 18, wherein said selection circuit is a circuit supplying a selection signal depending upon a printing density of an image to be printed.

30. An ink-jet printing head as set forth in claim 18, wherein said driving circuits are arranged along an aligning direction of said heating element.

31. An ink-jet printing head as set forth in claim 18, wherein said driving circuits are aligned in a direction intersecting an alignment direction of said heating elements.

32. An ink-jet printing head as set forth in claim 18, wherein said heating element is an electrothermal transducer.

33. An ink jet printing head according to claim 18, wherein said plurality of heating elements provided for each of said plurality of ejection openings are divided into a plurality of groups, and said selection circuit selects at least one of said groups for driving.

34. An ink jet printing head according to claim 18, wherein the number of the bits is smaller than the total number of said heating elements.

35. An ink-jet printing apparatus using an ink-jet printing head capable of ejecting an ink through a plurality of ejection openings for printing an image on a printing medium, said ink-jet printing apparatus comprising:

means for relatively moving said printing head and said printing medium; said ink-jet printing head including a plurality of passages respectively communicated with respective of said ejection openings, and a substrate for an ink-jet element;

said substrate for an ink-jet element comprising:

a plurality of heating elements provided for each of said plurality of ejection openings and generating a thermal energy for ejecting the ink;

a data holding circuit for holding an image data for driving said heating elements, by holding said image data whose bits are the same in number as said ejection openings;

a selection circuit for selecting at least one of said plurality of heating elements provided corresponding to each of said ejection openings for driving; and a driving circuit for driving said heating elements selected by said selection circuit based on said image data corresponding to each of said ejection openings.

36. An ink-jet printing apparatus as set forth in claim 35, wherein said data holding circuit and said selection circuit are integrally built-in in said substrate for the ink-jet element.

37. An ink-jet printing apparatus as set forth in claim 35, wherein said driving circuit is provided on a one-by-one basis relative to said plurality of heating elements.

38. An ink-jet printing apparatus as set forth in claim 35, wherein said driving circuit is provided per each of said ejection openings corresponding to said plurality of heating elements.

39. An ink-jet printing apparatus as set forth in claim 35, wherein respective one ends of said heating elements are electrically connected to a wiring for a power supply.

40. An ink-jet printing apparatus as set forth in claim 39, wherein, in said wiring for the power supply, a switching element operable depending upon a control signal for driving said heating elements is provided.

41. An ink-jet printing apparatus as set forth in claim 35, which further comprises a common wiring electrically connected to said plurality of heating elements and, in said common wiring, a switching element operable depending upon a drive signal for driving said heating elements.

42. An ink-jet printing apparatus as set forth in claim 35, wherein said plurality of heating elements provided corresponding to each of said ejection openings are differentiated in heat generation amount relative to each other.

43. An ink-jet printing apparatus as set forth in claim 42, wherein each of said plurality of heating elements has a wiring connecting portion having an area depending upon a respective heat generation amount.

44. An ink-jet printing apparatus as set forth in claim 35, wherein said driving circuit includes an N-MOS transistor.

45. An ink-jet printing apparatus as set forth in claim 35, wherein said selection circuit is a circuit for supplying a selection signal corresponding to respective ones of said plurality of heating elements per each of said ejection openings.

46. An ink-jet printing apparatus as set forth in claim 35, wherein said selection circuit is a circuit supplying a selection signal depending upon a printing density of an image to be printed.

47. An ink-jet printing apparatus as set forth in claim 35, wherein said driving circuits are arranged along an aligning direction of said heating element.

48. An ink-jet printing apparatus as set forth in claim 35, wherein said driving circuits are aligned in a direction intersecting an alignment direction of said heating elements.

49. An ink-jet printing apparatus as set forth in claim 35, wherein said heating element is an electrothermal transducer.

50. An ink jet printing apparatus according to claim 35, wherein said plurality of heating elements provided for each of said plurality of ejection openings are divided into a plurality of groups, and said selection circuit selects at least one of said groups for driving.

51. An ink jet printing apparatus according to claim 35, wherein the number of the bits is smaller than the total number of said heating elements.

* * * * *